US008273417B2

(12) United States Patent
Gale et al.

(10) Patent No.: US 8,273,417 B2
(45) Date of Patent: Sep. 25, 2012

(54) SPRAY COATING SYSTEM AND METHOD

(75) Inventors: Roger Gale, Angus (CA); Stephen Gervais, Collingwood (CA)

(73) Assignee: Honda Motor Co., Ltd., Tokyo (JP)

( * ) Notice: Subject to any disclaimer, the term of this patent is extended or adjusted under 35 U.S.C. 154(b) by 864 days.

(21) Appl. No.: 12/263,387

(22) Filed: Oct. 31, 2008

(65) Prior Publication Data

US 2010/0098871 A1 Apr. 22, 2010

(30) Foreign Application Priority Data

Oct. 22, 2008 (CA) ..... 2641508

(51) Int. Cl.
*B05D 1/02* (2006.01)
*B05C 5/02* (2006.01)

(52) U.S. Cl. ..... 427/427.2; 118/300; 118/302; 239/1; 239/290; 239/291; 239/294

(58) Field of Classification Search ..... 118/300, 118/302; 239/423, 424, 424.5, 434.5, 290, 239/291, 294, 1; 901/43; 427/427.2
See application file for complete search history.

(56) References Cited

U.S. PATENT DOCUMENTS 4,555,058 A * 11/1985 Weinstein et al. ..... 239/223
5,175,018 A 12/1992 Lee et al.
6,929,698 B2 * 8/2005 Shutic et al. ..... 118/683
2005/0001061 A1 * 1/2005 Mauchle et al. ..... 239/423

* cited by examiner

*Primary Examiner* — Laura Edwards
(74) *Attorney, Agent, or Firm* — Standley Law Group LLP

(57) ABSTRACT

The present invention is directed to a robotic spray coating assembly and method for spraying a coating. The assembly may include a robotic arm having a remote end region and a coating head mounted on the remote end region. The coating head emits a coating material within a defined coating delivery region via at least one first orifice located in the coating delivery region, the at least one first orifice connected to a coating supply. One or more second orifices are positioned in a pattern beyond the periphery of the coating delivery region, and a fluid supply is connected to the one or more second orifices. Fluid emitted from the one or more second orifices forms a fluid curtain that at least partially encircles the coating delivery region, thereby minimizing overspray emerging therefrom. The present invention also discloses a vehicle spray painting system and a method of spray painting a vehicle.

9 Claims, 5 Drawing Sheets

SPRAY COATING SYSTEM AND METHOD

CROSS-REFERENCE TO RELATED APPLICATIONS

As authorized by 35 U.S.C. §119, this application claims priority to and hereby incorporates by reference Canadian Application Serial No. 2,641,508, titled ANNULAR AIR CURTAIN FOR ROBOTIC PAINT SYSTEMS, filed on Oct. 22, 2008.

INVENTIVE FIELD

The present invention is directed to a system and method for spraying a coating, such as paint. More particularly, the present invention is directed to a robotic spray coating assembly and method for spraying a coating.

BACKGROUND OF THE INVENTIVE FIELD

Robotic spray coating systems are widely used on manufacturing lines. In some cases, robotic spray coating systems may coat objects with paint, although other materials may also be sprayed. While robotic spray coating systems are useful for providing superior finishes, such systems can often produce an accumulation of coating material due to "overspray". This occurs when trace coating material particles leaving a coating spray do not set on a target work piece and instead drift away and deposit on surrounding structures, including expensive robotic components. This requires time consuming regular cleaning procedures and, in some cases, may risk reduced coating quality.

Consequently, it can be understood that it would be desirable to reduce overspray in robotic spray coating applications. The present invention is directed to a robotic spray coating assembly and method for spraying a coating that reduces overspray, as well as a vehicle spray painting system utilizing such a robotic spray coating assembly.

SUMMARY OF THE GENERAL INVENTIVE CONCEPT

The present invention is directed to an overspray-reducing robotic spray coating assembly and its associated method of use. The present invention also contemplates a vehicle spray painting system and a vehicle painted therewith. A coating applied by an assembly, system or method of the present invention may be paint, or may be another of various sprayable materials that would be familiar to one skilled in the art.

A robotic spray coating assembly of the present invention generally includes a robotic arm having a remote end region and a coating head mounted on the remote end region. The coating head may have a housing that defines a coating delivery region. The assembly my have at least one first orifice located in the coating delivery region, with a coating material supply connected to the first orifice. One or more second orifices may be positioned in a pattern beyond the periphery of the coating delivery region. A fluid supply may be connected to the one or more second orifices to form a fluid curtain that encircles the coating delivery region to minimize overspray emerging therefrom. The fluid used to form the fluid curtain may be air or another fluid that would be familiar to one skilled in the art.

In certain embodiments of the present invention, the coating head housing may include an outer peripheral surface with a ring portion being positioned on the outer peripheral surface and the one or more second orifices located in the ring portion. In these embodiments, the ring portion may have one or more second orifices located on a path along the outer surface.

The ring portion of certain embodiments of the present invention may include an annular chamber, where each of the second orifices is in communication with the annular chamber. In certain embodiments, the ring portion has an inner surface with a first inner diameter, with the outer peripheral surface having a second outer diameter. Embodiments of the present invention may have one or more second orifices that are integrally formed with the remote end portion.

The present invention also includes methods of minimizing overspray by providing a robotic spray assembly as described above and emerging from a robotic spray coating assembly. Such a method preferably includes providing a robotic spray coating assembly with a coating head defining a coating delivery region, the coating delivery region including at least one coating delivery orifice; providing one or more fluid curtain orifices positioned in a fluid curtain pattern at or beyond the periphery of the coating delivery region; directing the coating delivery region at a work piece; delivering a supply of coating material to the coating orifice to produce a coating spray pattern beyond the coating delivery region so as to form a coating on the work piece; and delivering a fluid to the fluid curtain orifice(s) to form a fluid curtain to minimize coating overspray emerging from the coating delivery region. The coating material applied by a method of the present invention may be paint, or may be another of various sprayable materials that would be familiar to one skilled in the art. The fluid used to form the fluid curtain according to a method of the present invention may be air, or may be another fluid that would be familiar to one skilled in the art.

The present invention is also directed specifically to a vehicle painting system. In a vehicle painting system of the present invention, a robot coating assembly is associated with a coating line provided to carry a plurality of vehicle bodies to be painted along a vehicle painting path. A robotic arm is preferably located adjacent the vehicle painting path. The robotic spray painting assembly of the above-described method of minimizing overspray is deployed on the robotic arm. The present invention also includes a method of painting a vehicle body using such a vehicle painting system.

The present invention further contemplates a work piece comprising a coating formed by the above-described method. The work piece may be a vehicle body. The coating applied to the work piece may be paint or another of various sprayable materials that would be familiar to one skilled in the art.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
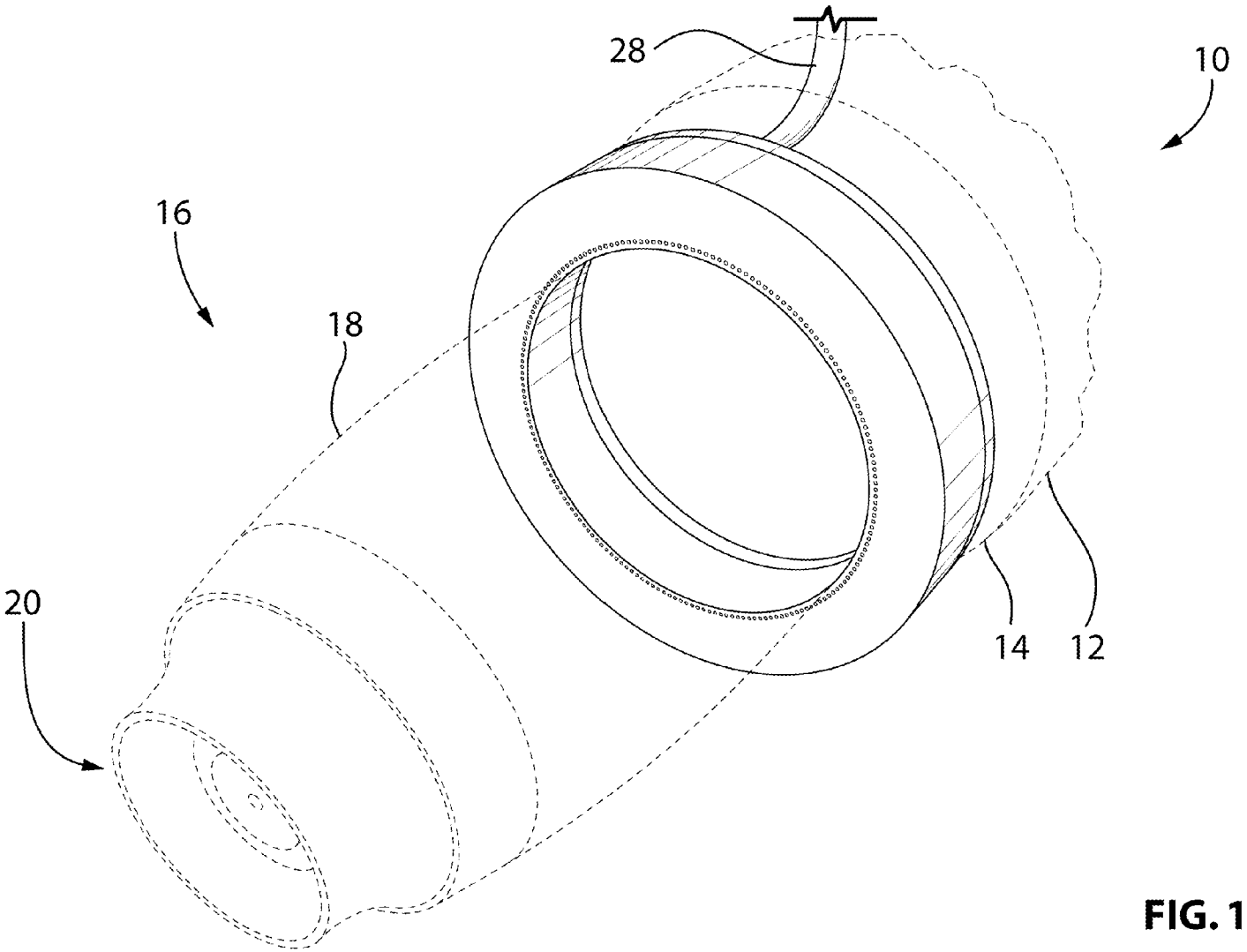
FIG. 1 is a fragmentary perspective view illustrating one exemplary embodiment of a robotic coating assembly of the present invention.

It should be understood that the present invention is not limited in its application to the details of construction and the arrangement of components set forth in the following description or illustrated in the associated drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention. However, other alternative mechanical configurations are possible which are considered to be within the teachings of the instant disclosure. Furthermore, unless otherwise indicated, the term "or" is to be considered inclusive.

Figure 5:
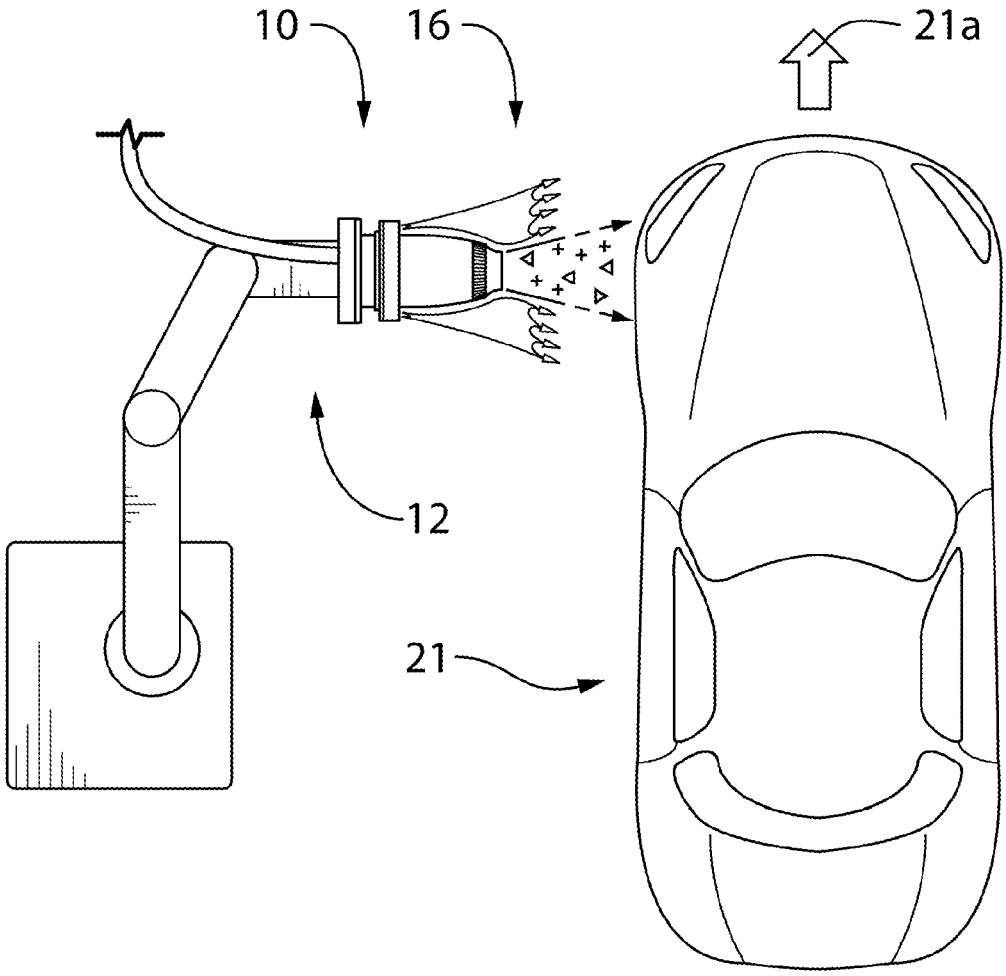
FIG. 5 is a plan view depicting an exemplary embodiment of a robotic coating assembly in an operative configuration.

FIG. 1 depicts an exemplary embodiment of a robotic spray coating assembly 10 of the present invention. As shown, this particular robotic spray coating assembly includes a robotic arm 12 having a remote end region 14. A coating head 16 is mounted on the remote end region 14 and has a housing 18 defining a coating delivery region 20, for spray coating a work piece. The work piece may be a vehicle body 21, as shown in FIG. 5. The work piece (e.g., vehicle body) may be spray coated while traveling along the path 21*a* of a coating line.

Figure 3:
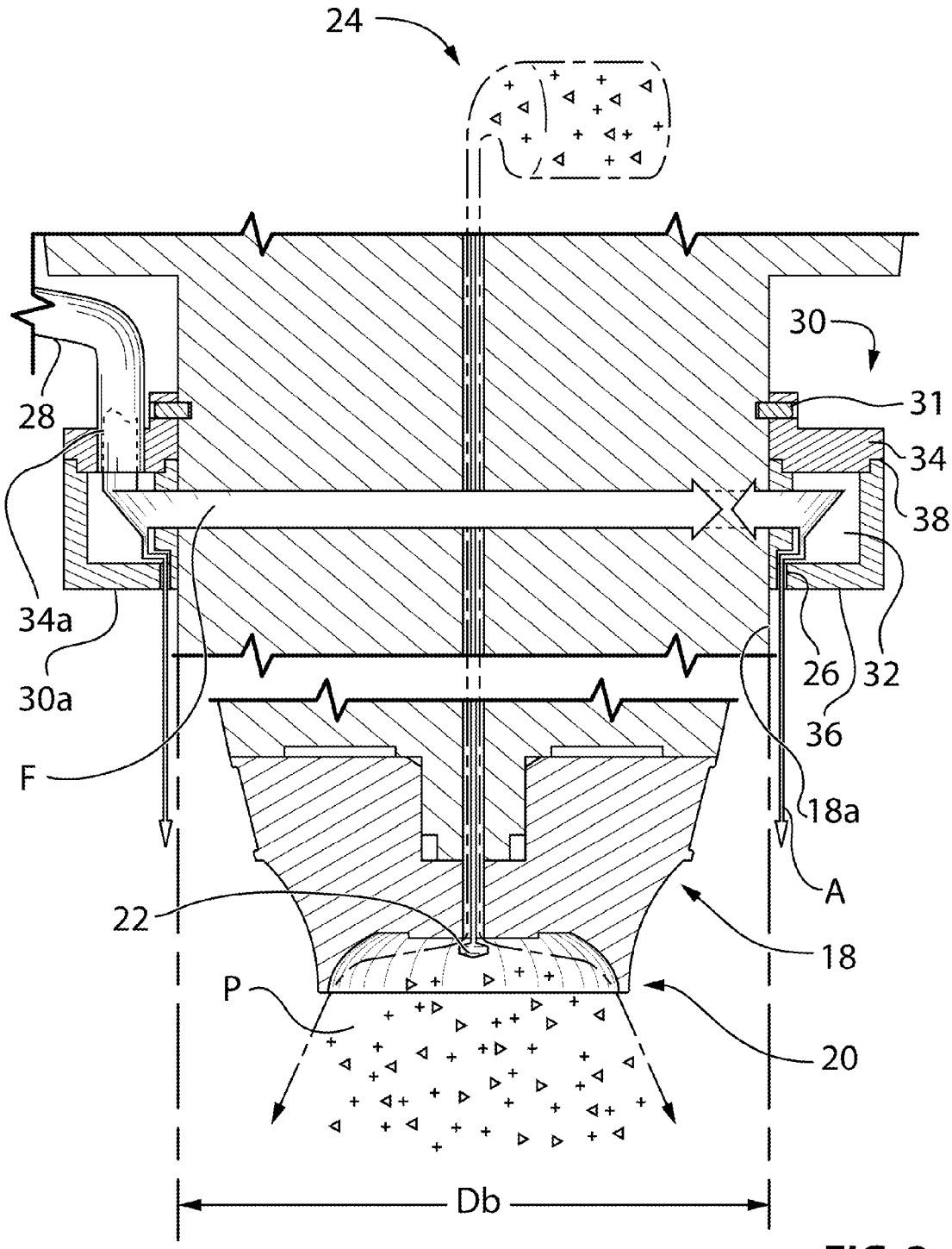
FIGS. 3 and 4 are operational sectional views of the exemplary embodiment of FIG. 1.

Referring to FIG. 3, at least one first orifice 22 is located in the coating delivery region 20, and a coating supply (shown schematically at 24) is connected to the first orifice. The coating supply 24 may comprise paint or another coating material.

Figure 2:
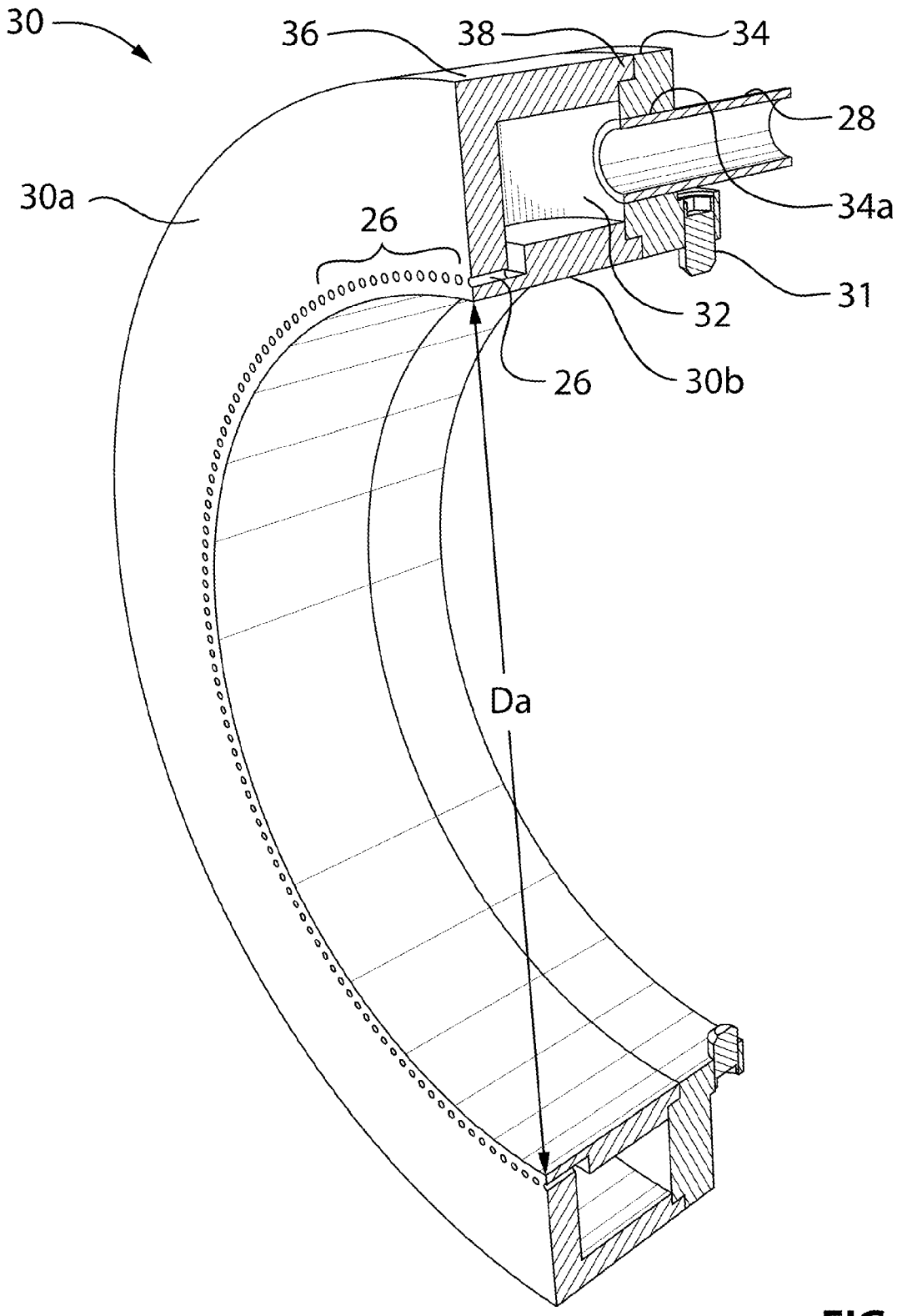
FIG. 2 is a fragmentary perspective view of a ring portion of the exemplary embodiment of FIG. 1.

Referring to FIGS. 2 and 3, one or more second orifices 26 are provided. In this example, the one or more second orifices 26 are positioned in a pattern beyond the periphery of the coating delivery region 20. A fluid supply line 28 may be in fluid communication with the second orifice(s) 26 and a source of pressurized fluid (not shown) to form a fluid curtain, represented schematically by A in FIGS. 3 and 4. The fluid curtain A encircles the coating delivery region 20 to minimize overspray emerging therefrom. Depending on the volume flow requirements of the fluid curtain A, one or more additional fluid supply lines 28 may be added as needed. As would be understood by one skilled in the art, the fluid curtain A may be comprised of air or another fluid.

In the example of FIG. 3, the housing 18 includes an outer peripheral surface 18*a*. A ring portion 30 is positioned on the outer peripheral surface 18*a* and is affixed thereto by a locking member 31, such as a set screw or the like. The locking member 31 may be positioned in a complementary recess, groove or passage in the outer peripheral surface 18*a*. In this case, the second orifices 26 may be located in the ring portion 30. More particularly, the ring portion 30 may have an outer surface 30*a*, which faces, or is otherwise oriented toward, the coating delivery region 20. In this case, the second orifices 26 may be located on a path along the outer surface 30*a*.

As shown in FIGS. 2 and 3, some exemplary embodiments of the present invention may have an annular chamber 32 located within the ring portion 30. In this case, each of the second orifices 26 may be in communication with the annular chamber 32. The ring portion 30 of this particular example is formed by an annular base member 34, which has an annular recessed member 36 joined at an interface 38 therebetween. The annular base member 34 includes a passage 34*a* to receive the fluid supply line 28. The annular base member 34 and recessed member 36 may together form the annular chamber 32, which receives a supply of fluid F from the supply line 28 and distributes the fluid to the second orifices 26 to form the fluid curtain A.

Referring to FIG. 2, this particular ring portion 30 has an inner surface 30*b* with a first inner diameter Da. Referring now to FIG. 3, the outer peripheral surface 18*a* may have a second outer diameter Db. In this case, the first inner diameter Da is dimensioned relative to the second outer diameter Db to permit a sliding fit between the ring portion 30 and the housing 18. In an alternative example, the second orifices 26, the annular chamber 32 and/or the fluid supply 28 may, if desired, be integrally formed with the remote end region 14.

Referring to FIG. 5, it can be observed that the robotic spray coating assembly 10 may provide for a method of coating an object or body, such as the exemplary vehicle body 21 shown. In this example, the robotic spray coating assembly 10 is used to coat the vehicle body 21 with paint, although other types of coatings may also be applied.

In this particular method, a robotic arm 12, equipped with the above-described coating head 16 and ring portion 30, is located adjacent a vehicle path 21*a*. The robotic arm 12 and robotic spray coating assembly 10 are then used to paint the vehicle body 21. More specifically, the robotic arm 12 is manipulated to direct the coating delivery region 20 of the robotic spray coating assembly 10 toward the vehicle body 21, so that a paint supply may be activated to form a coating spray pattern beyond the coating delivery region to apply a paint coating on the vehicle body. During the painting operation, a supply of paint is delivered to the coating head 16, and a supply of fluid is delivered to fluid curtain orifices located in the ring portion 30. The fluid is delivered to the fluid curtain orifices at a sufficient flow rate so as to be emitted therefrom to form the fluid curtain described above. This fluid curtain is operative to minimize paint overspray emerging from the coating delivery region 20.

To operate the particular robotic spray coating assembly 10, the ring portion 30 is installed on the housing 18 with the fluid supply line 28 inserted in, or in fluid communication with, the passage 34*a*. The fluid supply line 18 may then be pressurized with fluid F that fills the annular chamber 32, thereby causing the fluid to exit the second orifices and to establish the fluid curtain A. Next, the coating supply 24 is activated to form a spray or fluid stream of coating P (see FIGS. 3 and 4). In this exemplary embodiment, the coating shown is paint, but the coating may be other materials as previously explained.

Figure 4:
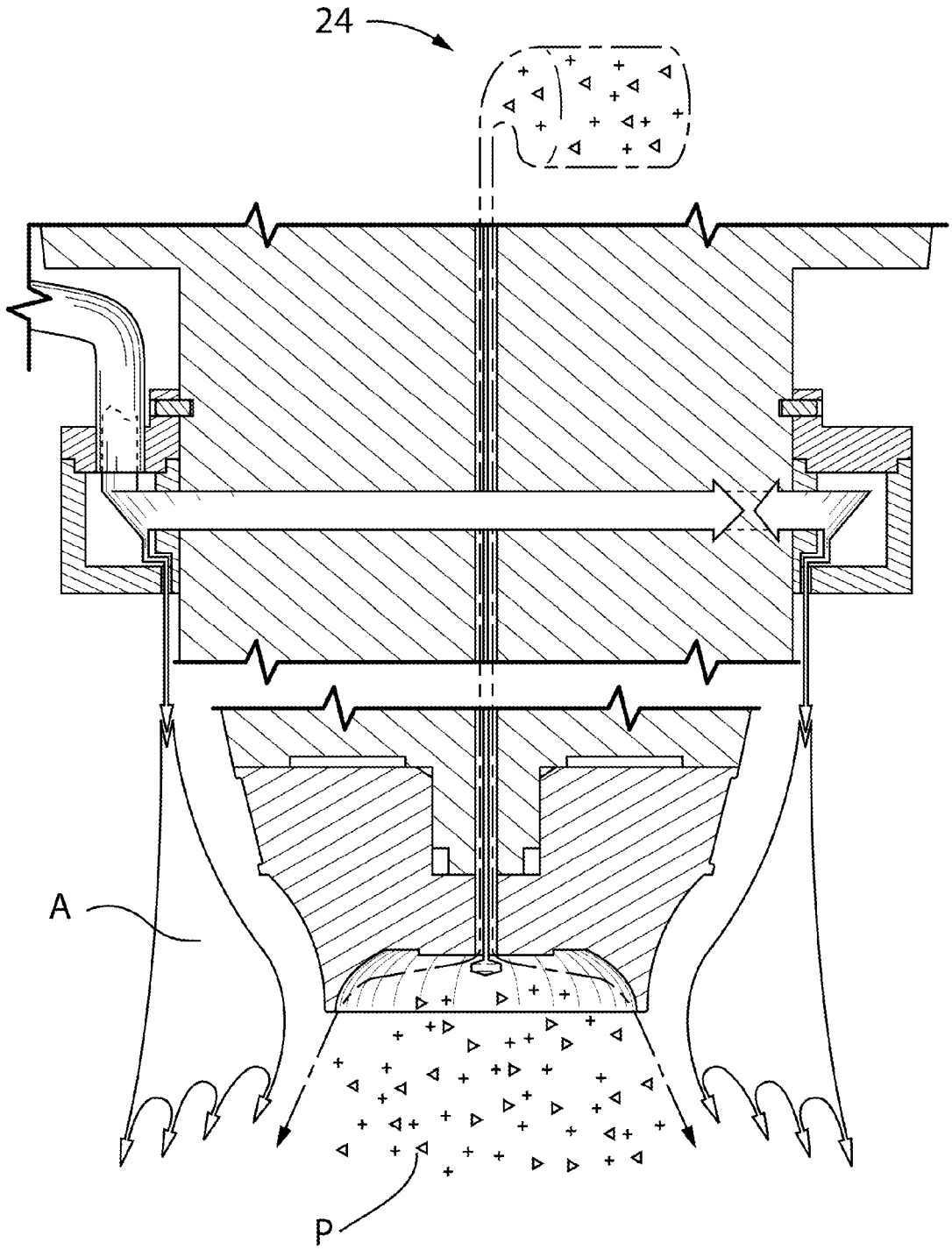

It should be noted that the sectional view of FIG. 4 is intended generally to demonstrate the orientation of the fluid curtain A. However, the sectional view of FIG. 4 is not intended to portray with strict accuracy the precise travel path of the coating fluid stream P or, for that matter, the fluid curtain A. The fluid curtain A is thus useful in limiting egress of coating particles beyond its boundaries and in reducing the accumulation of residual coating on other regions of the robotic arm 12. In this case, the characteristics of the fluid curtain may be influenced by the size, number and spacing of the second orifices, as well as by their cross sectional shape.

While second orifices of circular cross section have been found to produce good results, other cross-sections may also be employed.

In addition to the foregoing, it may be desirable to provide a robust fluid supply, which may include air or a mixture of air and other liquids such as water. The pressure associated with such a fluid supply may range from about 30 pounds per square inch (psi) to about 80 psi. It should be noted, however, that excessive fluid supply pressures may be ineffective in some cases, and may actually interfere with the spray or coating stream of fluid P.

Thus, as shown and described herein, embodiments of the present invention are useful to minimize coating overspray on a robot gun and spray nozzle or cap, by way of an air ring. The ring may be configured to slide over the base of the gun and to be held thereon with a number (e.g., three) of set screws. One or more air lines (e.g., two) may be used to supply air around the ring. Such air lines may have various diameters, such as a diameter of about 6 mm for example. According to this construction, fluid (e.g., air) enters a chamber within the air ring, from which it is subsequently dispersed through pilot holes. The pilot holes may be of various diameter, such as for example, approximately 1 mm in diameter or larger. The diameter of the pilot holes may depend on the requirements of the resulting air curtain. In other embodiments, the pilot holes may be replaced by one or more elongate slots or the like.

In operation, the air travels along the shaft of the gun, which in turn forces the overspray back into the coating path and off of the gun. While the ring portion and its structure to provide the fluid curtain is particularly useful to retrofit existing coating assemblies, the second orifices and the annular chamber, or functional equivalents of the second orifices and the annular chamber, may be integrated into the housing, as desired, to provide a pattern beyond the periphery of the coating delivery region so as to form the air curtain as described. The ring portion may be provided in a kit for retrofitting existing coating assemblies or may be included in the assembly of coating assemblies. While such a ring portion is especially well-suited to use on a robotic spray coating assembly, it may also be applicable to manual coating assemblies in some cases. Further, while the second orifices have been shown and described as forming a fluid curtain that surrounds the entire coating delivery region, there may be applications in which it may be useful to produce a fluid curtain along only a portion of the boundary of the coating delivery region. Thus, it is not required in all cases that the fluid curtain encircle the entire delivery region.

While certain embodiments of the present invention are described in detail above, the scope of the invention is not to be considered limited by such disclosure, and modifications are possible without departing from the spirit of the invention as evidenced by the following claims. The scope of said claims is to be accorded the broadest interpretation so as to encompass all such modifications and equivalent structures and functions.

What is claimed is:

1. A method of reducing coating overspray emerging from a robotic spray coating assembly, comprising:

providing the robotic spray coating assembly, which comprises:

a robotic arm having a remote end region;

a coating head, mounted on the remote end region, the coating head comprising:

a housing that narrows and extends axially away from the remote end region, defining a coating delivery region;

a first orifice, located in the coating delivery region; and a supply of coating material, connected to the first orifice;

a ring portion, mounted in a sliding fit around an outer peripheral portion of the housing, radially outwardly from the coating head, the ring portion having one or more second orifices connected to a fluid supply, the second orifices positioned for supplying a curtain of the fluid along the periphery of the housing toward the coating delivery region; and a locking member, affixing the ring portion to the housing;

directing the coating delivery region at a work piece;

delivering the supply of coating material to the first orifice to form a coating spray pattern beyond the coating delivery region to apply a coating to the work piece; and delivering the fluid to the second orifices to form the fluid curtain, which encircles the coating delivery region so as to reduce overspray of the coating emerging from the coating delivery region.

2. A vehicle painting system, comprising:

a paint line to carry a plurality of vehicle bodies to be painted;

a robotic arm having a remote end region, the robotic arm being located adjacent the paint line;

a painting head mounted on the remote end region, the painting head comprising:

a housing that narrows and extends axially away from the remote end region, defining a paint delivery region;

a first orifice located in the paint delivery region; and a paint supply connected to the first orifice;

a ring portion, mounted in a sliding fit around the painting head, the ring portion having one or more second orifices connected to a fluid supply, the second orifices positioned for supplying a curtain of the fluid along the periphery of the housing toward the paint delivery region, the fluid curtain encircling the paint delivery region so as to reduce overspray of the coating; and a locking member, affixing the ring portion to an outer peripheral portion of the housing.

3. The assembly of claim 2, wherein the ring portion has an outer surface, the one or more second orifices located on a path along the outer surface.

4. The assembly of claim 3, wherein the ring portion includes an annular chamber, each of the second orifices in communication with the annular chamber.

5. The assembly of claim 4, wherein the ring portion has an inner surface with a first inner diameter, the outer peripheral surface has a second outer diameter, and wherein the first inner diameter is dimensioned relative to the second outer diameter to permit a sliding fit between the ring portion and the housing.

6. A robotic spray coating assembly, comprising:

a robotic arm having a remote end region;

a coating head, mounted on the remote end region, the coating head comprising:

a housing that narrows and extends axially away from the remote end region, defining a coating delivery region;

a first orifice, located in the coating delivery region; and a coating supply, connected to the first orifice;

a ring portion, mounted in a sliding fit around an outer peripheral portion of the housing, radially outwardly from the coating head, the ring portion having one or more second orifices connected to a fluid supply, the second orifices positioned for supplying a curtain of the fluid along the periphery of the housing toward the coating delivery region, the fluid curtain encircling the coating delivery region so as to reduce overspray of the coating; and a locking member, affixing the ring portion to the housing.

7. The assembly of claim 6, wherein the ring portion has an outer surface, the one or more second orifices located on a path along the outer surface.

8. The assembly of claim 7, wherein the ring portion includes an annular chamber, each of the second orifices in communication with the annular chamber.

9. The assembly of claim 8, wherein the ring portion has an inner surface with a first inner diameter, the outer peripheral surface has a second outer diameter, and wherein the first inner diameter is dimensioned relative to the second outer diameter to permit a sliding fit between the ring portion and the housing.

* * * * *